United States Patent [19]

Figiel et al.

[11] 4,279,664

[45] Jul. 21, 1981

[54] AZEOTROPE-LIKE COMPOSITIONS OF TRICHLOROTRIFLUOROETHANE, ACETONE AND N-HEXANE

[75] Inventors: Francis J. Figiel, Boonton; Aaron Colbert, Livingston, both of N.J.

[73] Assignee: Allied Chemical Corporation, Morris Township, Morris County, N.J.

[21] Appl. No.: 138,486

[22] Filed: Apr. 9, 1980

[51] Int. Cl.[3] ..... B08B 7/00

[52] U.S. Cl. ..... 134/38; 101/424; 134/40; 252/171; 252/DIG. 9

[58] Field of Search ..... 252/DIG. 9, 171, 364; 134/38, 40; 101/424

[56] References Cited

U.S. PATENT DOCUMENTS

| | | | |
|---|---|---|---|
| 2,999,815 | 9/1961 | Eiseman | 252/171 |
| 3,573,213 | 3/1971 | Burt | 252/172 |
| 3,607,767 | 9/1971 | Schofield | 252/171 |
| 3,728,268 | 4/1973 | Burt | 252/171 |
| 3,789,006 | 1/1974 | McMillan | 252/171 |
| 3,903,009 | 9/1975 | Bauer | 252/171 |
| 4,045,366 | 8/1977 | Figiel | 252/171 |
| 4,096,083 | 6/1978 | Clementson | 134/38 |

FOREIGN PATENT DOCUMENTS

| | | | |
|---|---|---|---|
| 54-107528 | 8/1979 | Japan | 134/38 |

*Primary Examiner*—S. Leon Bashore
*Assistant Examiner*—Michael Goldman
*Attorney, Agent, or Firm*—Jay P. Friedenson

[57] ABSTRACT

Azeotrope-like compositions consisting essentially of 1,1,2-trichloro-1,2,2-trifluoroethane, acetone and n-hexane have utility as degreasing agents and as solvents to remove polymeric binders containing inks, such as carbon black which are used in copy machines.

6 Claims, No Drawings

AZEOTROPE-LIKE COMPOSITIONS OF TRICHLOROTRIFLUOROETHANE, ACETONE AND N-HEXANE

DESCRIPTION

Background of the Invention

Fluorocarbon solvents, such as trichlorotrifluoroethane, are widely used as degreasing agents due to their excellent solvent power for greases and some emulsion-type lubricants. Since trichlorotrifluoroethane is non-polar, however, it does not remove polar contaminants. Thus, to overcome this inability, trichlorotrifluoroethane has, in the past, been mixed with polar components, such as aliphatic alcohols.

The art has looked towards azeotropic compositions including desired fluorocarbon components, such as trichlorotrifluoroethane, which include the desired polar components, and other components which contribute desired characteristics, such as stabilizers. Azeotropic compositions are desired because they exhibit a minimum boiling point and do not fractionate upon boiling. This is desirable because in vapor degreasing equipment, in which these solvents are employed, redistilled material is generated for final rinse-cleaning. Thus, the vapor degreasing system acts as a still. Unless the solvent composition exhibits a constant boiling point, i.e. is an azeotrope or is azeotrope-like, fractionation will occur and undesirable solvent distribution may act to upset the cleaning and safety of processing. Preferential evaporation of the more volatile components of the solvent mixtures, which would be the case if they were not azeotropic, or azeotropic-like, would result in mixtures with changed compositions which may have less desirable properties, such as lower solvency and increased flammability.

A number of trichlorotrifluoroethane based azeotropic compositions have been discovered which have been tested and in some cases employed as solvents for miscellaneous vapor degreasing applications. For example, U.S. Pat. No. 2,999,815 discloses the azeotrope of 1,1,2-trichloro-1,2,2-trifluoroethane with acetone; U.S. Pat. No. 3,607,767 discloses the ternary azeotrope of 1,1,2-trichloro-1,2,2-trifluoroethane with methylene chloride and cyclopentane; U.S. Pat. No. 3,903,009 discloses the ternary azeotrope of 1,1,2-trichloro-1,2,2-trifluoroethane with nitromethane and ethanol; U.S. Pat. No. 3,573,213 discloses the binary azeotrope of 1,1,2-trichloro-1,2,2-trifluoroethane with nitromethane; U.S. Pat. No. 3,789,006 discloses the ternary azeotrope of 1,1,2-trichloro-1,2,2-trifluoroethane with nitromethane and isopropanol; U.S. Pat. No. 3,728,268 discloses the ternary azeotrope of 1,1,2-trichloro-1,2,2-trifluoroethane with acetone and ethanol; U.S. Pat. No. 4,045,365 discloses the ternary azeotrope of 1,1,2-trichloro-1,2,2-trifluoroethane with acetonitrile and acetone.

Unfortunately, as is recognized in the art, it is not possible to predict the formation of azeotropes and this obviously complicates the search for new azeotropic systems which have application in this field. Nevertheless, there is a constant effort in the art to discover new azeotropic or azeotrope-like systems which have desirable solvency characteristics for particular applications.

It is accordingly an object of this invention to provide novel azeotropic or azeotrope-like compositions based on 1,1,2-trichloro-1,2,2-trifluoroethane which have good solvency power and other desirable properties for vapor degreasing applications and particularly for polymeric binders containing inks, such as those used in copy machines.

It is a particular object of this invention to provide novel solvent compositions as above described which are non-flammable.

Other objects and advantages of the invention will be apparent from the following description.

DESCRIPTION OF THE INVENTION

In accordance with the invention, novel azeotrope-like compositions have been discovered comprising 1,1,2-trichloro-1,2,2-trifluoroethane, acetone and n-hexane. Such azeotrope-like compositions comprise about 80–84.4 weight percent of 1,1,2-trichloro-1,2,2-trifluoroethane, about 12.6–15.8 weight percent of acetone and about 3.4 weight percent of n-hexane. Such compositions have a minimum boiling point at 760 mm Hg of about 43.5° to 44.5° C. The precise azeotrope composition has not been determined but has been ascertained to be within the above ranges. Regardless of where the true azeotrope lies, all compositions within the indicated ranges, as well as certain compositions outside the indicated ranges, are azeotrope-like, as defined more particularly below.

It has been found that these azeotrope-like compositions are stable, safe to use and are non-flammable (exhibit no flash point when tested by the Tag Open Cup test method—ASTM D1 310–16) and exhibit excellent solvency power which make such compositions particularly effective in vapor degreasing applications and particularly for the removal of polymeric binders containing inks, such as those used in copy machines.

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted to non-azeotrope-like compositions in which during boiling or evaporation, the liquid composition changes to a substantial degree.

As is well known in this art, another characteristic of azeotrope-like compositions is that there is a range of compositions containing the same components in varying proportions which are azeotrope-like. All such compositions are intended to be covered by the term azeotrope-like as used herein.

The 1,1,2-trichloro-1,2,2-trifluoroethane, acetone and n-hexane components of the novel solvent compositions of the invention are commercially available. Preferably they should be used in sufficiently high purity so as to avoid the introduction of adverse influences upon the solvency properties or constant boiling properties of the system. A suitable grade of 1,1,2-trichloro-1,2,2-trifluoroethane, for example, is sold by Allied Chemical Corporation under the trade name "GENESOLV D".

The novel azeotrope-like compositions of the invention may be purified and reclaimed for use after saturation with dissolved materials by simple flash distillation.

The novel azeotrope-like compositions of this invention may be used to clean a variety of materials such as synthetic organic polymers, plastics, resins, resin laminates, resin-bonded paperboard, bakelite, metals such as gold plated tungsten steel wires, fiberglass and like materials. The novel solvents of the invention are particularly well suited for the removal of polymeric binders containing inks such as carbon black, which are used in copy machines.

Vapor degreasers are generally used to carry out the solvent cleaning operations. In conventional operation of a vapor degreaser, the article to be cleaned is passed into a sump of boiling solvent, which removes the bulk of the resin, and thereafter through a sump containing freshly distilled solvent near room temperature, and finally through solvent vapors over the boiling sump which provides a final rinse with clean, pure solvent which condenses on the article. In addition, the article can also be sprayed with distilled solvent before final rinsing.

From the above description it can be appreciated that a preferred process embodiment of the invention involves cleaning a solid surface comprising contacting said surface with a novel azeotrope-like composition in accordance with this invention.

A still preferred process embodiment of the invention involves so cleaning a solid surface which is an article contaminated with a polymeric binder containing an ink. The ink typically consists of carbon black and the binder typically consists of a polymeric organic compound which may contain ketone and/or aliphatic hydrocarbon groups.

The novel solvent mixtures of the invention find other applications, such as for removing greases and oils from a variety of industrial items, for the cleaning of photographic films and prints, for the removal of buffing compounds, such as rouge, and for the cleaning of hydraulic air conditioning systems.

It will be apparent to those skilled in the art that for specialized purposes, various additives could be incorporated with the novel solvent mixtures of the invention; for example, lubricants, detergents and the like. These additives are chosen so as not to adversely affect the essential properties of the mixtures for a given application.

EXAMPLE 1

Approximately 3,000 milliliters of a solvent mixture were prepared containing about 80.0 weight percent of 1,1,2-trichloro-1,2,2-trifluoroethane, about 10 weight percent of acetone and about 10 weight percent of n-hexane. This mixture was distilled utilizing a five liter, three-necked distillation glass containing a four plate column and a distillation head. The first and last fractions of about 300 ml were discarded and the remaining fractions were redistilled. Again, the first and last fractions were discarded. The barometric pressure was measured during the distillations at 757.8 mm Hg. The distillation rate was about 500 ml/15 minutes. Five fractions were collected at 45° C. which has a density between 1.302 to 1.304 g/ml at 22° C. Analysis of the five fractions by gas chromatograph averaged as follows:

TABLE I

| | Percent Weight |
|---|---|
| 1,1,2-trichloro-1,2,2-trifluoroethane | 80.0 |
| acetone | 15.8 |
| n-hexane | 4.2 |

EXAMPLE 2

The procedure of Example 1 was repeated except that the initial composition contained about 80.0 weight percent of 1,1,2-trichloro-1,2,2-trifluoroethane, about 15.8 weight percent acetone and about 4.2 weight percent n-hexane. The barometric pressure was 763.5 mm Hg. The distillation rate was about 500 ml/15 minutes. The boiling point of the fractions recovered ranged between 44°–45° C. The specific gravity was between about 1.304 and 1.306 g/ml at 22° C. Analysis of the five fractions by gas chromatograph averaged as follows:

TABLE II

| | Percent Weight |
|---|---|
| 1,1,2-trichloro-1,2,2-trifluoroethane | 84.4 |
| acetone | 12.6 |
| n-hexane | 3.0 |

EXAMPLE 3

Approximately 2,000 milliliters of a solvent mixture were prepared containing about 84.0 weight percent of 1,1,2-trichloro-1,2,2-trifluoroethane, about 13.0 weight percent of acetone and about 3.0 weight percent of n-hexane. This mixture was distilled using a two liter, three-necked distillation glass with a five plate glass column and a distillation head. The first fraction consisting of about 200 ml was discarded. The barometric pressure during distillation was 743.5 mm Hg. The distillation rate was about 500 ml/15 minutes. Three fractions were recovered having a boiling point of 43.5° C. and a density of 1.380 g/ml at 22° F. Analysis of the three fractions by gas chromatograph averaged as follows:

TABLE III

| | Percent Weight |
|---|---|
| 1,1,2-trichloro-1,2,2-trifluoroethane | 83.9 |
| acetone | 13.9 |
| n-hexane | 2.2 |

EXAMPLE 4

A standard measure of solvency for certain classes of solvents in the Kauri-Butanol value. This test (ASTM 1163–61) was made on an azeotrope-like composition in accordance with this invention. The established value was then compared with those of some related binary azeotropic systems and other common solvents. The results are given in Table IV.

TABLE IV

| Solvent | | Wt. % | K-B Value* |
|---|---|---|---|
| 1. 1,1,2-trichloro-1,2,2-trifluoroethane | | 100.0 | 29.5 |
| 2. acetone | | | test not applicable |
| 3. n-hexane | | | 30.0** |
| 4. 1,1,2-trichloro-1,2,2-trifluoroethane | blend | 90.3 | 42.5 |
| acetone | | 9.4 | |
| n-hexane | | 0.3 | |
| 5. 1,1,1-trichloro-1,2,2-trifluoroethane | blend | 88.0 | 48.5 |
| acetone | | 12.0 | |
| 6. 1,1,2-trichloro-1,2,2-trifluoroethane | blend | 55.0 | 148.0 |
| methylene chloride | | 41.7 | |

TABLE IV-continued

| Solvent | | Wt. % | K-B Value* |
|---|---|---|---|
| methyl alcohol | | 3.3 | |
| 7. 1,1,2-trichloro-1,2,2-trifluoroethane | blend | 84.0 | 60.0 |
| acetone | | 13.0 | |
| n-hexane | | 3.0 | |

*These values may vary from analyst to analyst due to the nature of the test.
**Reported in literature.

The above data show that the K-B value for the azeotrope-like composition of the invention (Blend No. 7) is substantially higher than that of the 1,1,2-trichloro-1,2,2-trifluoroethane (Solvent No. 1) or n-hexane (Solvent No. 3) components alone and higher than that of the ternary azeotrope of Solvent No. 4 and also than that of the binary azeotrope of Solvent No. 5.

As will be apparent from Example 6, despite the fact that the azeotrope-like composition Solvent No. 7 has a lower K-B value than Solvent No. 6, the azeotrope-like composition of the invention surprisingly performed better in certain cleaning tests.

EXAMPLE 5

To further indicate the solvency power of the azeotrope-like composition of the invention, the following test was conducted.

An azeotrope-like composition in accordance with the invention containing about 84.0 weight percent 1,1,2-trichloro-1,2,2-trifluoroethane, about 13.0 weight percent acetone and about 3.0 weight percent n-hexane was utilized to clean aluminum cylinders 29.5 cm in height and 12 cm in diameter which were coated with Star-31, a toner manufactured by Hunt Chemical Company composed of carbon black and a polymer binder containing ketone and/or aliphatic hydrocarbon groups. This is illustrative of those polymeric binders containing inks commonly used in copy machines. A 3,500 ml beaker was charged with a gallon of the above solvent composition. The cylinders were inserted vertically and completely immersed in the solvent composition, and subjected to 15 minutes of ultrasonic vibration at a frequency of 40 to 90 Khz with the predominate vibration at 40 Khz. The cylinders were then removed from the beaker and were inspected. The surface of the cylinders were found to be free of ink and polymeric residue.

EXAMPLE 6

An indentical cylinder as described in Example 5 was immersed in 4 cm of the same azeotropic-like composition of the invention (Solvent composition No. 8 in Table IV) and ultrasonics applied as before and the cylinder removed. The other end of the same cylinder was then immersed in Solvent No. 7, as described in Table IV above, and ultrasonics applied as before. Visual inspection of the two ends of the cylinder showed some slight ink specks on the end of the cylinder treated with Solvent composition No. 7, but none on the end of the cylinder treated with the azeotrope-like composition of the invention. Since Solvent composition No. 7 has a higher KB value (148) as compared to a K-B value of 60' for the azeotrope-like composition of the invention, the superior results obtained with the latter was surprising.

EXAMPLE 7

Tin plated metal panels measuring 3 by 5 inches were cleaned with acetone and wiped with a cloth. A toner manufactured by Hunt Chemical Compay, Star-31, which is composed of carbon black and a binder consisting of a polymeric compound containing ketone and/or aliphatic hydrocarbon groups, was sprinkled on the panels and subjected to a temperature of 400° F. for one hour. When the panels were removed from the oven, the toner was completely fused. Rubbing tests were performed by wetting a rag with the azeotrope-like mixture of the invention (Solvent composition No. 8 in Table IV) and rubbing the fused toner. The toner was completely removed.

We claim:

1. Azeotrope-like compositions comprising 1,1,2-trichloro-1,2,2-trifluoroethane, acetone and n-hexane.

2. Azeotrope-like compositions according to claim 1 comprising about 80–84.4 weight percent 1,1,2-trichloro-1,2,2-trifluoroethane, about 12.6–15.8 weight percent acetone and about 3–4.2 weight percent n-hexane.

3. The method of cleaning a solid surface which comprises treating said surface with an azeotrope-like composition as defined in claim 1.

4. The method of cleaning a solid surface which comprise treating said surface with an azeotrope-like composition as defined in claim 2.

5. The method of cleaning a solid surface as described in claim 3 in which the solid surface is an article contaminated with a polymeric binder containing an ink.

6. The method of cleaning a solid surface as described in claim 4 in which the solid surface is an article contaminated with a polymeric binder containing an ink.

* * * * *